US006860332B1

(12) United States Patent
Archer et al.

(10) Patent No.: US 6,860,332 B1
(45) Date of Patent: Mar. 1, 2005

(54) FLUID DISPENSING ARRANGEMENT AND SKID PAN FOR A VEHICLE

(75) Inventors: David W. Archer, Hortonville, WI (US); Ryan F. Rowe, Middleton, WI (US)

(73) Assignee: Oshkosh Truck Corporation, Oshkosh, WI (US)

( * ) Notice: Subject to any disclaimer, the term of this patent is extended or adjusted under 35 U.S.C. 154(b) by 307 days.

(21) Appl. No.: 10/171,414

(22) Filed: Jun. 13, 2002

(51) Int. Cl.[7] ..... A62C 27/00

(52) U.S. Cl. ..... 169/24; 169/52; 169/710; 239/159; 239/164; 239/172; 239/288

(58) Field of Search ..... 169/24, 25, 51, 169/52, 70; 239/71, 159, 160, 164, 165, 172, 288–288.5, 754, 722

(56) References Cited

U.S. PATENT DOCUMENTS

| | | | | |
|---|---|---|---|---|
| 4,037,664 A | | 7/1977 | Gibson | |
| 5,004,156 A | * | 4/1991 | Montanier | 239/164 |
| 5,113,946 A | * | 5/1992 | Cooper | 169/24 |
| 5,211,245 A | | 5/1993 | Relyea et al. | |
| 5,301,756 A | | 4/1994 | Relyea et al. | |
| 5,788,158 A | | 8/1998 | Relyea | |
| 5,839,664 A | | 11/1998 | Relyea | |
| 5,899,276 A | | 5/1999 | Relyea et al. | |
| 6,220,532 B1 | * | 4/2001 | Manon et al. | 239/672 |

FOREIGN PATENT DOCUMENTS

| | | |
|---|---|---|
| DE | 3620603 A1 | 1/1987 |
| FR | 1.471.914 | 3/1967 |
| FR | 2 380 176 | 9/1978 |
| WO | WO 01/76912 A1 | 10/2001 |

* cited by examiner

*Primary Examiner*—Steven J. Ganey
(74) *Attorney, Agent, or Firm*—Foley & Lardner LLP

(57) ABSTRACT

A fluid dispensing arrangement and skid pan for use with a fire fighting vehicle, with the vehicle defining an under-vehicle volume. The fluid dispensing arrangement comprises a fluid source, a nozzle support coupled to the vehicle and movable within at least a part of the under-vehicle volume. A nozzle assembly is supported by the nozzle support and is in fluid communication with a fluid source. An actuator is coupled to the nozzle support to move the nozzle support within at least a part of the under-vehicle volume.

44 Claims, 3 Drawing Sheets

FLUID DISPENSING ARRANGEMENT AND SKID PAN FOR A VEHICLE

BACKGROUND OF THE INVENTION

The invention relates to vehicles in general and in particular to a fluid dispensing arrangement for use with a vehicle and a skid pan for protection of a device coupled to a vehicle.

Prior art vehicles utilizing fluid dispensing devices typically have been in fire fighting vehicles having aerial lifts and fluid nozzles on an outer end of a boom mechanism. Typically, the booms are mounted on the top side of the vehicle at about its midsection. The boom then articulates or telescopes to various positions which can include in front of the vehicle. Prior art arrangements also include a bumper mounted fluid dispensing nozzle that is mounted on a telescoping boom coupled to the front of a fire vehicle or fixed on the front bumper of the vehicle.

The prior art arrangements do not provide any protection for the nozzle arrangements that are mounted at the end of the booms nor do the prior art arrangements allow for convenient, close placement of the nozzle to a fire source or work area. The geometry of the booms and their locations on the fire fighting vehicle necessitates certain height restrictions in order for the boom to obtain the proper angle with respect to the nozzle placement and the work area.

An airport fire fighting vehicle must comply with certain requirements published by the National Fire Protection Agency and the Federal Aviation Administration. One such requirement is that the approach and departure angle of the vehicle (as defined by such agencies) must be a minimum of 30 degrees and that equipment must be clear of the approach angle area.

Thus, there is a need for a fluid dispensing arrangement for use with a vehicle, particularly a fire fighting vehicle that will allow a nozzle assembly to be in close proximity to a fire source or work area without height restrictions. There is further need for a skid pan for use with a multi-wheel vehicle to protect a device coupled to the vehicle particularly in an under-vehicle volume. There is a further need for a fire fighting vehicle that maintains a clear approach and departure angle but with the capability of exposing equipment within the approach and departure angle area.

SUMMARY OF THE INVENTION

There is provided a fluid dispensing arrangement for use with a fire-fighting vehicle, with the vehicle defining an under-vehicle volume. The fluid dispensing arrangement comprises a fluid source, a nozzle support coupled to the vehicle and movable within at least a part of the under-vehicle volume. A nozzle assembly is supported by the nozzle support and is in fluid communication with a fluid source. An actuator is coupled to the nozzle support to move the nozzle support. Another embodiment of the fluid dispensing arrangement includes a skid pan coupled to the nozzle support. Wherein, the nozzle support includes a first member and a second member, with the members maintained in a spaced apart relationship by a traverse member, with at least one of the first and second member in fluid communication with the fluid source and the nozzle assembly.

There is also provided a work vehicle comprising a support structure having a plurality of wheels coupled to the support structure. The wheels maintain the support structure above a surface with the support structure and wheels defining and under-vehicle volume over the surface. A modular independent suspension coupled to each wheel. A fluid source is associated with the vehicle. A multi-position nozzle assembly comprising a nozzle support coupled to the vehicle and movable within at least a part of the under-vehicle volume. A nozzle assembly is supported by the nozzle support and is in fluid communication with the fluid source. An actuator is coupled to the nozzle support to move the nozzle support. Wherein, the nozzle support includes a first member and a second member, with the members maintained in a spaced apart relationship by a traverse member, with at least one of the first and second member in fluid communication with the fluid source and the nozzle assembly. Another embodiment includes a skid pan coupled to the support structure.

Additionally, there is provided a fluid dispensing assembly on a fire-fighting vehicle, with the vehicle defining an under-vehicle volume. The fluid dispensing assembly comprises a fluid source, a means for supporting coupled to the vehicle and movable within at least part of the under-vehicle volume. A means for dispensing fluid is supported by the means for supporting and is in fluid communication with the fluid source. A means for actuating is coupled to the means for supporting to move the means for supporting within at least a part of the under-vehicle volume. Wherein, the means for supporting includes a first member and a second member, with the members maintained in a spaced apart relationship by a traverse member, with at least one of the first and second member in fluid communication with the vehicle and the means for dispensing fluid.

There is further provided a fluid dispensing arrangement for use with a fire-fighting vehicle with the vehicle defining an under-vehicle volume. The fluid dispensing arrangement comprises a fluid source and a nozzle support pivotably connected to the vehicle and movable within at least a part of the under-vehicle volume. A nozzle assembly is supported by the nozzle support and is in fluid communication with the fluid source. An actuator is coupled to the nozzle support to move the nozzle support. Wherein, the nozzle support includes a first member and a second member, with the members maintained in a spaced apart relationship by a traverse member, with at least one of the first and second member in fluid communication with the fluid source and the nozzle assembly.

There is also provided a skid pan for use with a multi-wheel vehicle with the vehicle having a body and a defining an under-vehicle volume. The skid pan comprises a plate configured as part of the vehicle body, a coupler engaging the plate and the vehicle and an actuator coupled to the plate to move the plate within at least a part of the under-vehicle volume, wherein the coupler is a pivotal connector.

Additionally, there is provided a work vehicle comprising a support structure with a plurality of wheels coupled to the support structure. The wheels maintain the support structure above a surface with the support structure and wheels defining an under-vehicle volume. A modular independent suspension coupled to each wheel. A movable skid pan for positioning a device within at least a portion of the under-vehicle volume, wherein the work vehicle is a fire truck.

There is also provided a skid pan for protection of a device with the device coupled to a vehicle having a body and the vehicle defining an under-vehicle volume. Thr skid pan comprises a plate and a coupler engaging the plate and the vehicle wherein the plate moves within the under-vehicle volume and protects the device, wherein the coupler is a pivotal connector.

DETAILED DESCRIPTION OF THE EXEMPLARY EMBODIMENTS

Figure 1:
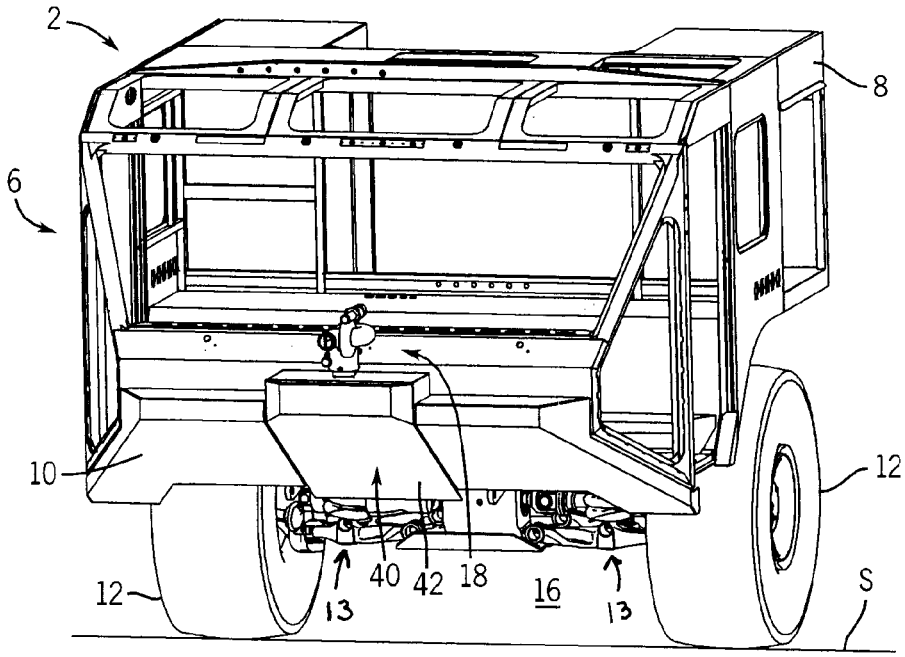
FIG. 1 is a partial perspective view of a multi-wheel vehicle including an exemplary embodiment of a fluid dispensing arrangement having a skid pan configured to the vehicle body contours.

Before discussing exemplary embodiments of the fluid dispensing arrangement and skid pan for a vehicle 2, there are a few preliminary comments. For purposes of this application, the phrase "under-vehicle volume" means that the volume defined by the support structure 4 of a vehicle 2, the plurality of wheels 12 supporting the support structure 4 over a surface S and the surface S itself. It is contemplated that the outside plane of each wheel 12 and the outermost plane of the vehicle body 10 will be used to establish the perimeter lines for four of the under-vehicle volume boundaries. The underside of the vehicle 2, typically the frame 4 and/or vehicle body 10 portions will be used for a boundary and the surface that the vehicle 2 is over provides the sixth boundary defining the under-vehicle volume 16. As will be appreciated, the volume is not fixed but will vary with the shape of the vehicle 2 and the surface S over which it is located.

When referring to a vehicle 2, it is contemplated that a vehicle 2 can be of several different uses and is referred to as a work vehicle 2, a fire fighting vehicle 2, a crash truck 2, a multi-wheel vehicle 2 and the like. It is also contemplated that articulated tracks mounted on the wheels 12 can be used as a support for the support structure 4 of a vehicle 2. The vehicle 2 also typically has an area designated as vehicle front 6, vehicle side 8 and includes a vehicle body 10. It is contemplated that any convenient and conventional materials can be utilized for such vehicle portions commensurate with the type of duty that will be experienced by such vehicle. For example, the body can be made out of steel, aluminum, or composite materials. The wheels 12 can be cast or machined, etc.

The fluid source 14 can be mounted directly on a vehicle 2, can be towed on a separate trailer structure, or can be a fixed fluid source 14 such as a lake, river or tank. For example, if the vehicle 2 is configured as a fire fighting vehicle, the fluid source 14 is typically mounted on the vehicle 2, or the vehicle 2 can be brought to an independent fluid source 14 which then utilizes the vehicle 2 for pumping purposes.

Figure 2:
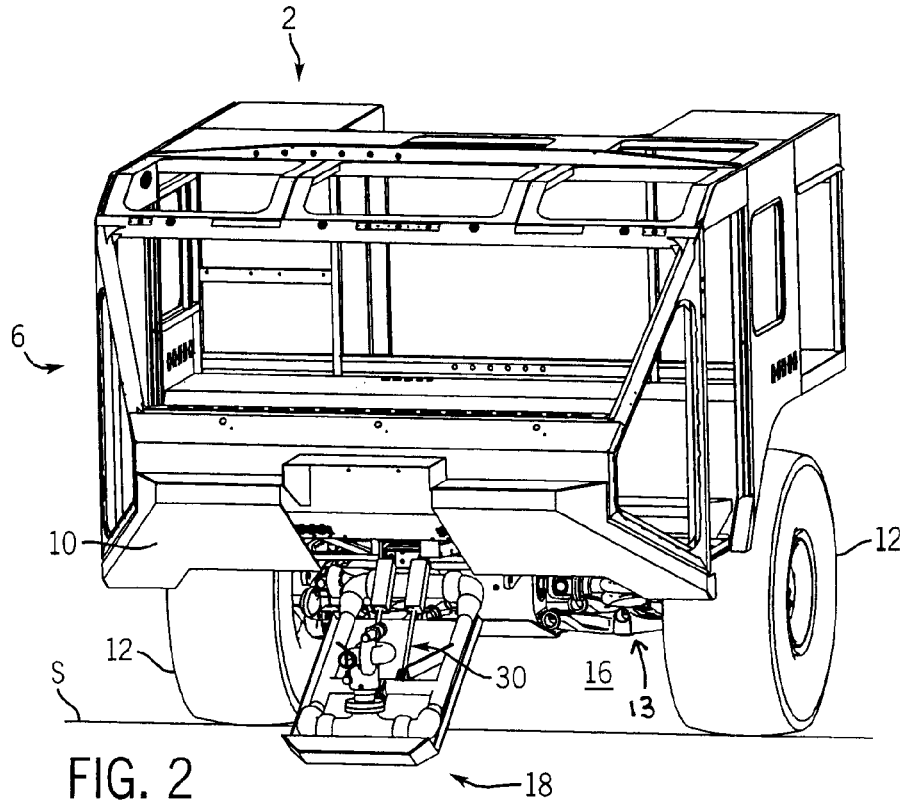
FIG. 2 is a partial perspective view of a multi-wheel vehicle illustrated in FIG. 1 with the fluid dispensing arrangement in an operating position within a portion of an under-vehicle volume.
Figure 3:
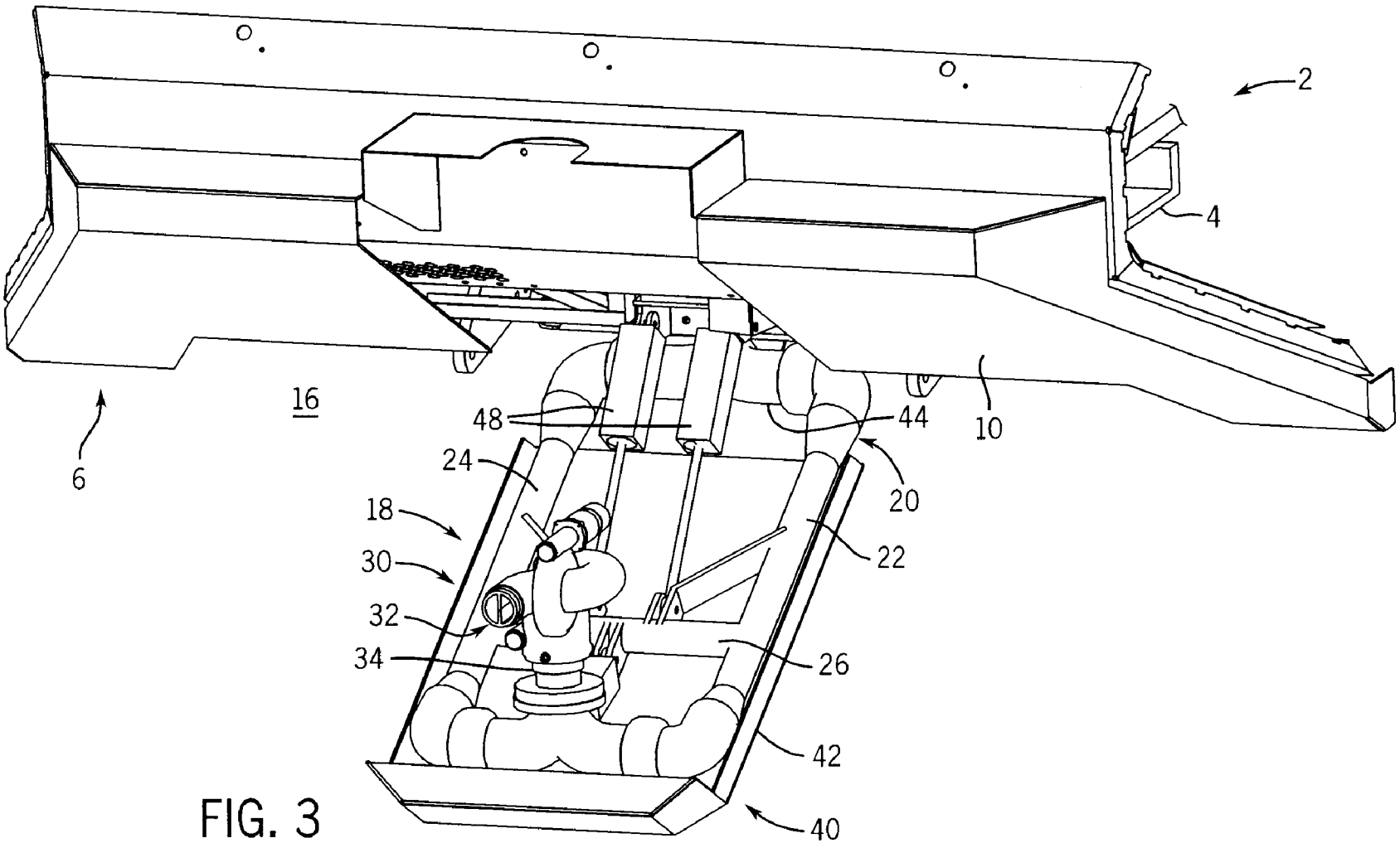
FIG. 3 is a partial perspective view of a work vehicle with an exemplary embodiment of a movable skid pan for positioning a device within at least a portion of the under-vehicle volume.
Figure 4:
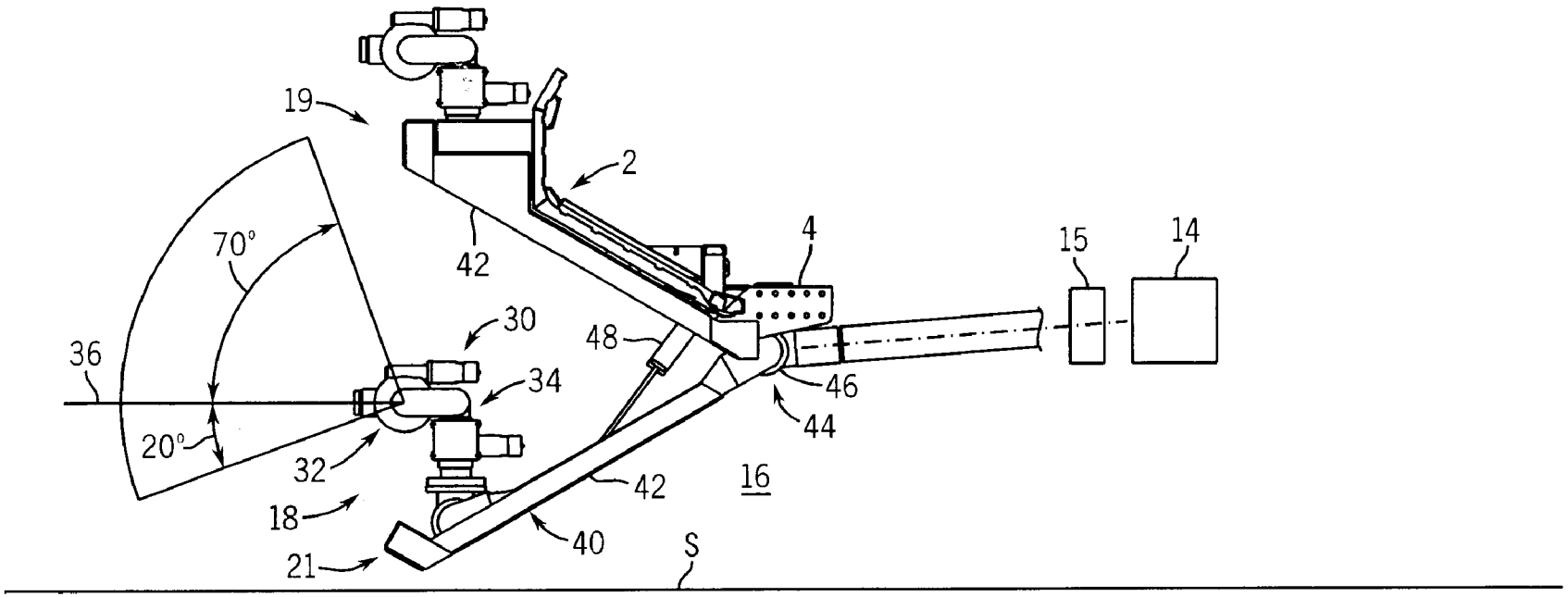
FIG. 4 is a side view of an exemplary embodiment of a fluid dispensing arrangement for use with a fire fighting vehicle and movable within at least a part of the under-vehicle volume in a first and second position.

Referring now to the figures, FIG. 1 illustrates a partial perspective view of a vehicle 2 such as a fire fighting vehicle 2 with the vehicle defining an under-vehicle volume 16 with a fluid dispensing arrangement 18 mounted to the vehicle front 6. The fluid dispensing arrangement 18 is shown in what can be referred to as a closed or first position 19. FIG. 2 is a partial perspective illustration of the vehicle 2 in FIG. 1 but with the fluid dispensing arrangement 18 in an opened or second position 21. Referring now to FIGS. 3 and 4, there is shown a fluid dispensing arrangement 18 for use with a vehicle 2, with the vehicle 2, defining an under-vehicle volume 16. The fluid dispensing arrangement 18 comprises a fluid source 14, a nozzle support 20 coupled to the vehicle 2 and movable within at least a part of the under-vehicle volume 16. A nozzle assembly 32 is supported by the nozzle support 20. The nozzle assembly 32 is in fluid communication with the fluid source 14. Fluid communication can be made through a hose and reel assembly 15. An actuator 48 is coupled to the nozzle support 20 to move the nozzle support 20 within at least a part of the under-vehicle volume 16. The actuator 48 can be a pneumatic, hydraulic, or electrical device having suitable strength and power to manipulate the skid pan 40 and associated support assembly 20. The actuator 48 can be controlled remotely from the vehicle 2 cab or other suitable location on or near the vehicle 2.

The nozzle support 20 can include a first member 22 and a second member 24 with the members maintained in a spaced apart relationship by a traverse member 26 with at least one of the first and second members 22, 24 in fluid communication with the fluid source 14 and the nozzle assembly 32. It is contemplated that the first and second members can be hollow, tubular members having either a round or square cross-section and coupled to the fluid source 14 by appropriate plumbing and valving assemblies. It is contemplated that either the first or second member is in fluid communication with the fluid source 14 and in some embodiments both members, 22, 24 are both in fluid communication with the fluid source 14 and the nozzle assembly 32.

A skid pan 40 can be coupled to the nozzle support 20. Such coupling can be by any convenient method such as fasteners, welding, or casting of the skid pan 40 and nozzle support 20 as a single piece.

The nozzle assembly 32 can include any number of outlets and valving assemblies but can rotate at least 180° in a horizontal plane and at least 90° in a vertical plane. With respect to the vertical plane, the rotation in the vertical plane can include at least 20° below a horizontal reference line 36 as illustrated in FIG. 4.

A work vehicle 2 can include a support structure 4 which is sometimes referred to as a frame to which a plurality of wheels 12 are coupled to support the support structure 4. The wheels 12 maintain the support structure 4 above a surface S with the support structure 4 and the wheels 12 defining an under-vehicle volume 16 over the surface S as described above.

Each wheel 12 is coupled to a modular independent suspension 13. (See FIGS. 1 and 2) The modular independent suspension 13 includes a coil spring for steerable and non-steerable wheel assemblies and drive and non-drive axles. The modular independent suspension 13 is coupled to the support structure and to each wheel and wheel assembly of the fire-fighting vehicle. An example of such modular independent suspension 13 is more fully described in U.S. Pat. Nos. 5,538,274 and 5,820,150 commonly assigned to the assignee of the present application. Such disclosures are incorporated herein by this reference.

A fluid source 14 is associated with the vehicle and as explained above, can be mounted on the vehicle 2, towed in a trailer behind the vehicle or be a fixed location such as from a hydrant, water type or body of water. The multiposition nozzle assembly 32 including a nozzle support 20 is coupled to the vehicle 2 and movable within at least a part of the under-vehicle volume 16. A nozzle assembly 32 is supported by the nozzle support 20 and is in fluid communication with the fluid source 14. Fluid communication can occur through a hose and reel assembly 15. An actuator 48 is coupled to the nozzle support 20 to move the nozzle support 20 within at least a part of the under-vehicle volume 16.

As discussed above, the vehicle 2 can be a fire truck or a crash truck. For this application a fire truck means a municipal fire truck equipped to fight structural building fires and typically is not considered an off-road vehicle. For this application, a crash truck means an airport rescue fire fighting vehicle equipped to fight aircraft fires and fuel fires. The crash truck is configured for off-road use. A typical application of a fluid dispensing assembly 18 described herein is on a fire truck or crash truck utilized at an airport and is called upon in the event of an airplane crash at or near the airport. The nozzle assembly 32 will typically have a motion assembly 34 associated with it for controlling the motion of the nozzle assembly 32 in both the horizontal and vertical directions. The motion assembly 34 can be controlled either manually or remotely from the vehicle 2 depending on the particular circumstances in which the vehicle 2 is being utilized. The motion assembly 34 will typically include motor, gears and levers that will impart controlled motion to a device 30, such as a nozzle assembly 32.

The nozzle support 20 is coupled to the vehicle 2 by a coupler 44 which can also be a pivotal connector 46 to facilitate the motion of the nozzle support 20 within the under-vehicle volume 16. It is also contemplated that the nozzle support 20 can also be moved in a linear fashion with a telescope coupler 44.

The skid pan 40 for use with a multi-wheel vehicle 2 is also shown in the figures. A vehicle 2 having a body 10 and defining an under-vehicle volume 16 is provided with a skid pan 40. The skid pan 40 comprises a plate 42 configured as part of the vehicle body 10 with a coupler 44 engaging the plate 42 and the vehicle 2. An actuator 48 is coupled to the plate 42 to move the plate 42 within at least a part of the under-vehicle volume 16. The skid pan 40 can include a nozzle assembly 32 supported by the plate 42 wherein the plate 42 protects the nozzle assembly 32. Another embodiment of the skid pan 40 can include a first member 22 and a second member 24 with the members maintained in a spaced apart relationship by a traverse member 26. Either the first or the second member, 22, 24 can be in fluid communication with the nozzle assembly 32. The nozzle assembly 32 can be configured to rotate at least 180° in a horizontal plane and at least 90° in a vertical plane as described above. The skid pan 40 can utilize a pivotal connector 46 type of coupler 44 as illustrated in FIGS. 3 and 4.

It is contemplated that the skid pan 40 can be utilized along any of the major axis of the vehicle 2. For instance, the skid pan described herein can be mounted on a vehicle side 8 or as illustrated in the figures at the vehicle front 6. It is also contemplated that the skid pan 40 can be mounted at the rear vehicle however appropriate and convenient application of the skid pan 40 and associated apparatus, such as the support assembly 20 and device 30, will be paramount to the designer and user of the work vehicle 2.

A work vehicle 2 comprising a support structure 4 and a plurality of wheels 12 is also contemplated with the wheels coupled to the support structure 4 and maintaining the support structure 4 above a surface. The support structure 4 and the wheels 12 define an under-vehicle volume 16. A movable skid pan 40 can be used for positioning a device 30 within at least a portion of the under-vehicle volume 16. The work vehicle 2 can be a fire truck and the device 30 can be a multi-position nozzle assembly 32.

It is also contemplated that the device 30 can be any other type of tool that is appropriate for a given application such as for instance a video camera, for example an infrared video camera, a spot or search light, a hose and reel assembly, hydraulically actuated jaws for manipulating metal or such other appropriate tool for use with a work vehicle.

The skid pan 40 also functions to protect a device 30 with the device 30 being coupled to the vehicle 2. The skid pan 40 comprises a plate 42 and a coupler for engaging the plate 42 and the vehicle 2. The plate 42 moves within the under-vehicle volume 16 and protects the device 30. The plate 42 is configured to the vehicle body 10 contours as shown in FIG. 1. The plate 42 can be composed of material that is similar or identical to the vehicle 10 material or it can be a different material depending on the application and environment in which it will operate. For example, the body of the vehicle can be of steel or aluminum with the skid pan 40 plate 42 composed of a composite material of sufficient strength and resiliency to protect the device 30 that is associated with the skid pan 40.

The plate 42 can be a separate element from the support assembly coupled to the plate 42 and the device 30. It is also contemplated that the plate 42 and the support assembly 20 can be integrally formed such as by molding into a single piece. The plate 42 can be of any convenient shape or form including an angled form as depicted in FIGS. 1 and 4 wherein the skid pan 40 and the plate 42 are shown in a first position 19 and a second position 21. It is contemplated that as the work vehicle 2 travels to the work site it may have to negotiate uneven terrain or traverse various debris in the work field in order to get to the work area and position the device 30 in a operative position. While so moving to the work area, the skid plate 40 is in the first position 19, does not obstruct the approach or departure angle and protects the apparatus enclosed by the plate 42 and the rest of the vehicle body 10. Upon arriving at the work area, the skid pan is moved to a second position 21 which exposes the support assembly 20 and the device 30 as shown in FIG. 2.

In some instances, the device 30 is completely enclosed within the skid pan 40 and vehicle body 10 and in some instances, the device 30 is not fully enclosed as shown in FIG. 1.

Thus there is provided a fluid dispensing arrangement and skid pan for use with a vehicle with the vehicle defining an under-vehicle volume. While the embodiments illustrated in the figures and described above are presently preferred, it should be understood that these embodiments are offered by way of example only. The invention is not intended to be limited to any particular embodiment but is intended to extend to various modifications that nevertheless fall within the scope of the appended claims. For example, it is also contemplated that the nozzle assembly be configured to dispense water, fire retardant materials or foam. It is also contemplated that more than one device can be mounted on the support structure or the skid pan such as a fluid dispensing assembly together with a spotlight. Additional modifications will be evident to those with ordinary skill in the art.

What is claimed is:

1. A fluid dispensing arrangement for use with a fire-fighting vehicle, with the vehicle defining an under-vehicle volume, the fluid dispensing arrangement comprising:

a fluid source;

a nozzle support coupled to the vehicle and movable within at least a part of the under-vehicle volume;

a nozzle assembly supported by the nozzle support and in fluid communication with the fluid source; and, an actuator coupled to the nozzle support to move the nozzle support, wherein the nozzle support includes a first member and a second member, with the members maintained in a spaced apart relationship by a traverse member, with at least one of the first and second member in fluid communication with the fluid source and the nozzle assembly.

2. The fluid dispensing arrangement of claim 1, including a skid pan coupled to the nozzle support.

3. The fluid dispensing arrangement of claim 1, wherein the other of the first and second member is in fluid communication with the fluid source.

4. The fluid dispensing arrangement of claim 1, wherein the nozzle assembly can rotate at least 180° in a horizontal plane and at least 90° in a vertical plane.

5. The fluid dispensing arrangement of claim 4, wherein the rotation in the vertical plane includes at least 20° below a horizontal reference line.

6. A work vehicle comprising:

a support structure;

a plurality of wheels coupled to the support structure, wherein the wheels maintain the support structure above a surface, with the support structure and wheels defining an under-vehicle volume;

a modular independent suspension coupled to each wheel;

a fluid source associated with the vehicle; and, a multi-position nozzle assembly comprising:

a nozzle support coupled to the vehicle and movable within at least a part of the under-vehicle volume;

a nozzle assembly supported by the nozzle support and in fluid communication with the fluid source; and, an actuator coupled to the nozzle support to move the nozzle support, wherein the nozzle support includes a first member and a second member, with the members maintained in a spaced apart relationship by a traverse member, with at least one of the first and second member in fluid communication with the fluid source and the nozzle assembly.

7. The work vehicle of claim 6, including a skid pan coupled to the support structure.

8. The work vehicle of claim 6, wherein the other of the first and second member is in fluid communication with the fluid source.

9. The work vehicle of claim 6, wherein the nozzle assembly can rotate at least 180° in a horizontal plane and at least 90° in a vertical plane.

10. The work vehicle of claim 9, wherein the rotation in the vertical plane includes at least 20° below a horizontal reference line.

11. The work vehicle of claim 6, wherein the vehicle is a fire truck.

12. The work vehicle of claim 6, wherein the vehicle is a crash truck.

13. The work vehicle of claim 6, wherein the nozzle support is coupled under the support structure.

14. A fluid dispensing assembly on a fire-fighting vehicle, with the vehicle defining an under-vehicle volume, the fluid dispensing assembly comprising:

a fluid source;

a means for supporting coupled to the vehicle and movable within at least a part of the under-vehicle volume;

a means for dispensing fluid supported by the means for supporting and in fluid communication with the fluid source; and, an means for actuating coupled to the means for supporting to move the means for supporting, wherein the means for supporting includes a first member and a second member, with the members maintained in a spaced apart relationship by a traverse member, with at least one of the first and second member in fluid communication with the vehicle and the means for dispensing fluid.

15. The fluid dispensing assembly of claim 14, including a means for protecting coupled to the means for supporting.

16. The fluid dispensing assembly of claim 14, wherein the other of the first and second member is in fluid communication with the vehicle.

17. The fluid dispensing assembly of claim 14, wherein the means for dispensing fluid can rotate at least 180° in a horizontal plane and at least 90° in a vertical plane.

18. The fluid dispensing assembly of claim 17, wherein the rotation in the vertical plane includes at least 20° below a horizontal reference line.

19. A fluid dispensing arrangement for use with a fire-fighting vehicle, with the vehicle defining an under-vehicle volume, the fluid dispensing arrangement comprising:

a fluid source;

a nozzle support pivotally connected to the vehicle and movable within at least a part of the under-vehicle volume;

a nozzle assembly supported by the nozzle support and in fluid communication with the fluid source; and an actuator coupled to the nozzle support to move the nozzle support, wherein the nozzle support includes a first member and a second member, with the members maintained in a spaced apart relationship by a traverse member, with at least one of the first and second member in fluid communication with the fluid source and the nozzle assembly.

20. The fluid dispensing arrangement of claim 19, including a skid pan coupled to the nozzle support.

21. The fluid dispensing arrangement of claim 19, wherein the other of the first and second member is in fluid communication with the fluid source.

22. The fluid dispensing arrangement of claim 19, wherein the nozzle assembly can rotate at least 180° in a horizontal plane and at least 90° in a vertical plane.

23. The fluid dispensing arrangement of claim 22, wherein the rotation in the vertical plane includes at least 20° below a horizontal reference line.

24. A skid pan for use with a multi-wheel vehicle, with the vehicle having a body and defining an under-vehicle volume, the skid pan comprising:

a plate configured as part of the vehicle body;

a coupler engaging the plate and the vehicle; and, an actuator coupled to the plate to move the plate within at least a part of the under-vehicle volume, wherein the coupler is a pivotal connector.

25. The skid pan of claim 24, including a nozzle assembly supported by the plate, wherein the plate protects the nozzle assembly.

26. The skid pan of claim 25, wherein the plate includes a first member and a second member, with the members maintained in a spaced apart relationship by a traverse member, with at least one of the first and second member in fluid communication with the nozzle assembly.

27. The skid pan of claim 26, wherein the other of the first and second member is in fluid communication with the nozzle assembly.

28. The skid pan of claim 25, wherein the nozzle assembly can rotate at least 180° in a horizontal plane and at least 90° in a vertical plane.

29. The skid pan of claim 28, wherein the rotation in the vertical plane includes at least 20° below a horizontal reference line.

30. A work vehicle comprising:

a support structure;

a plurality of wheels coupled to the support structure, wherein the wheels maintain the support structure above a surface, with the support structure and wheels defining an under-vehicle volume;

a modular independent suspension coupled to each wheel; and a movable skid pan for positioning a device within at least a portion of the under-vehicle volume, wherein the work vehicle is a fire truck.

31. The work vehicle of claim 30, wherein the device is a multi-position nozzle assembly.

32. The work vehicle of claim 31, including a hose and reel assembly in fluid communication with the nozzle assembly.

33. The work vehicle of claim 31, wherein the nozzle assembly can rotate at least 180° in a horizontal plane and at least 90° in a vertical plane.

34. The work vehicle of claim 33, wherein the rotation in the vertical plane includes at least 20° below a horizontal reference line.

35. The work vehicle of claim 30, wherein the device is a video camera.

36. The work vehicle of claim 35, wherein the video camera is an infrared camera.

37. A skid pan for protection of a device, with the device coupled to a vehicle having a body and defining an under-vehicle volume, the skid pan comprising:

a plate; and, a coupler engaging the plate and the vehicle, wherein the plate moves within the under-vehicle volume and protects the device, wherein the coupler is a pivotal connector.

38. The skid pan of claim 37, including a support assembly coupled to the plate and the device.

39. The skid pan of claim 37, wherein the plate is configured to the vehicle body contours.

40. The skid pan of claim 39, wherein the plate is angled with respect to the body of the vehicle.

41. The skid pan of claim 37, wherein the device is a nozzle assembly.

42. The skid pan of claim 41, including a hose and reel assembly in fluid communication with the nozzle assembly.

43. The skid pan of claim 37, wherein the device is a video camera.

44. The skid pan of claim 43, wherein the video camera is an infrared camera.

* * * * *